United States Patent [19]

Pierson

[11] Patent Number: 5,000,582

[45] Date of Patent: Mar. 19, 1991

[54] COMBINATION BAG HOLDER AND BAG THEREFOR

[76] Inventor: Tyler V. Pierson, 616B Starlinda, Arlington, Tex. 76012

[21] Appl. No.: 364,963

[22] Filed: Jun. 12, 1989

Related U.S. Application Data

[62] Division of Ser. No. 139,725, Dec. 30, 1987, Pat. No. 4,860,981.

[51] Int. Cl.[5] ..... B65D 33/10

[52] U.S. Cl. ..... 383/7; 383/33; 383/75; 383/102; 383/117

[58] Field of Search ..... 383/7, 33, 72, 75, 102, 383/117

[56] References Cited

U.S. PATENT DOCUMENTS

| | | | |
|---|---|---|---|
| 1,941,871 | 1/1934 | Struve | 383/72 |
| 2,704,098 | 3/1955 | Pocock | 383/75 X |
| 2,789,610 | 4/1957 | Pritchard | 383/7 |
| 2,970,628 | 2/1961 | Tames | 383/7 |
| 3,132,794 | 5/1964 | Frazier | 248/99 X |
| 3,161,391 | 12/1964 | Bahnsen | 248/99 |
| 3,349,936 | 10/1967 | Morton et al. | 383/75 X |
| 3,369,584 | 2/1968 | Faccio et al. | 383/7 X |
| 3,409,063 | 11/1968 | Pokras | 383/7 |
| 4,120,335 | 10/1978 | Mitchell | 383/7 |
| 4,694,503 | 9/1987 | Hydorn | 383/12 |

*Primary Examiner*—Stephen Marcus
*Assistant Examiner*—Jes F. Pascua
*Attorney, Agent, or Firm*—James C. Fails; Arthur F. Zobal; Geoffrey A. Mantooth

[57] ABSTRACT

A combination bag holder and bag therefor characterized by a bag holder that has no standing vertical member from a freestanding base with a hanger rack means adjacent the top and holding a flexible permeable collection bag above the floor, the bag having a yoke that is open along its bottom to receive the hanger rack. Also disclosed are the hanger rack and the bag, per se.

1 Claim, 3 Drawing Sheets

COMBINATION BAG HOLDER AND BAG THEREFOR

This application is a division, of application Ser. No. 139,725, filed 12-30-87 now U.S. Pat. No. 4,860,981.

FIELD OF THE INVENTION

This invention relates to the field of collecting garments, such as laundry or dry cleaning, for later cleaning. More particularly, this invention relates to combination bag holder and bag that can collect the clothes of cleaning and the like and allow them to dry while being collected.

DESCRIPTION OF THE PRIOR ART

The prior art has seen the development of a wide variety of different types of bag holders and bags therefor, ranging from the bag holder which is the subject of old patent 94,283, issued in 1869, for holding flexible bags for leaves or the like through adjustable sack holders, such as described in U.S. Ser. No. 165,982, through portable bag holders with wheels, carriers or the like to removably supported hamper bags and supports for the same such as disclosed in U.S. Pat. No. 4,588,154.

Separately enclosed herewith is an Information Disclosure Statement citing and abstracting patents found in a pre-examination search.

None of the prior art discloses a holder and a bag for collecting clothes for laundry, dry cleaning or the like in which the clothes are held above the floor and under conditions such that they can dry if they have undue amount of moisture, yet will not mildew and such that the holder and bag can be emplaced on a floor against a wall and still have clearance at their top with respect to the wall.

SUMMARY OF THE INVENTION

Accordingly, it is an object of this invention to enable a combination bag holder and bag that will enable collecting clothes for laundry or dry cleaning or the like and supporting the clothes above the floor in a moisture permeable container and on a bag holder that provides a clearance at the top such that the bag is easily removed even though the base may touch the wall at the floor level.

It is a specific object of this invention to provide a bag adapted to collect the clothes and hold them in moisture permeable enclosure above the floor such that the clothes do not mildew but will dry out.

It is a specific object of this invention to provide a holder for a bag so as to hold the bag open adjacent the wall; yet, provide clearance at its top such that the bag could easily be removed without tipping over the holder even though the base of the holder may be against the wall.

These and other objects will become apparent from the descriptive matter hereinafter, particularly when taken in conjunction with the appended drawings.

In accordance with one embodiment of this invention there is provided a combination bag holder and bag for standing on a first surface such as a floor and receiving dirty clothes and the like characterized by a bag holder consisting essentially of a base, a vertical support means and a hanger rack and a collection bag suspended from the hanger rack, the bag having a flexible front and back that are sewed together and a yoke connected with the rear of the bag along its top and at least its bottom corners, but open at the bottom so as to receive the rack, the bag being shorter than the bag holder so that it is retained above the floor.

In another specific aspect there is provided a bag holder alone.

In still another specific aspect there is provided a bag alone.

DESCRIPTION OF PREFERRED EMBODIMENT(S)

Figure 1:
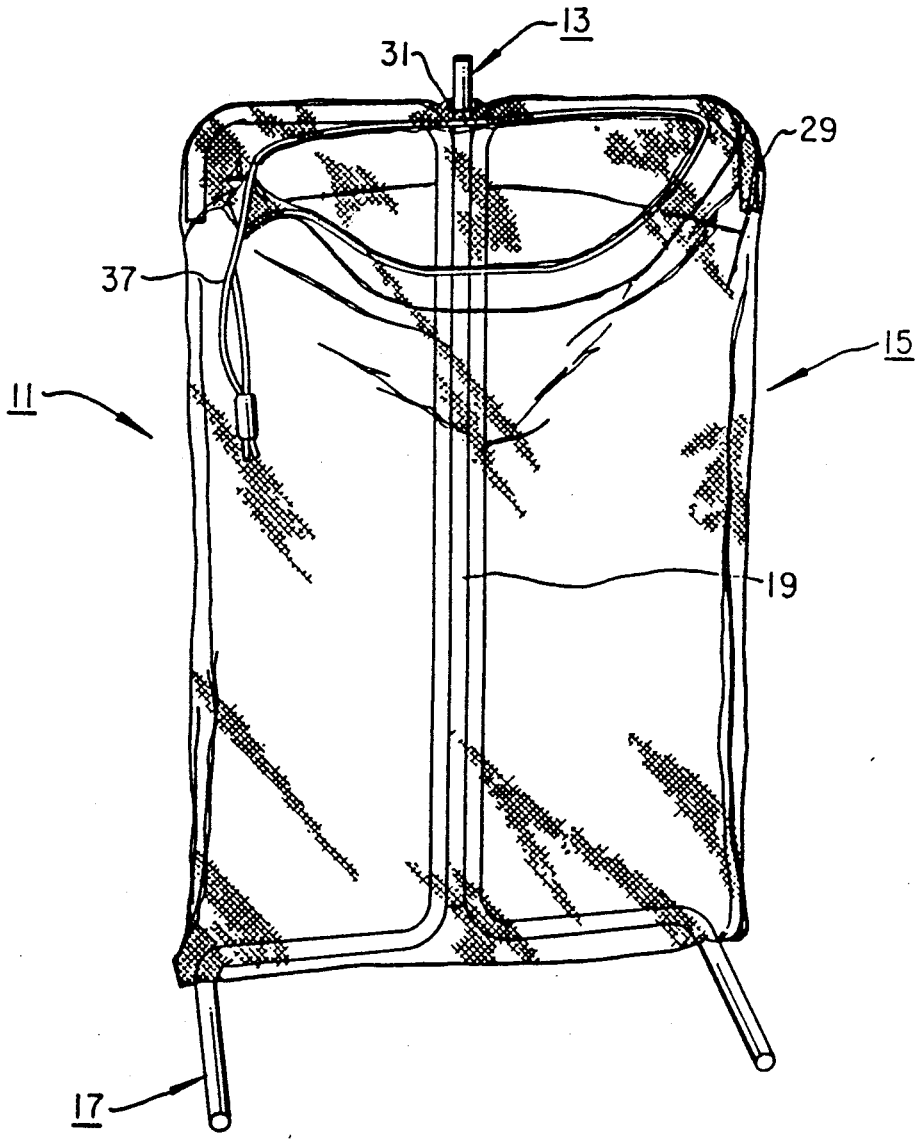
FIG. 1 is an isometric view of the combination bag holder and bag in accordance with one embodiment of this invention.
Figure 5:
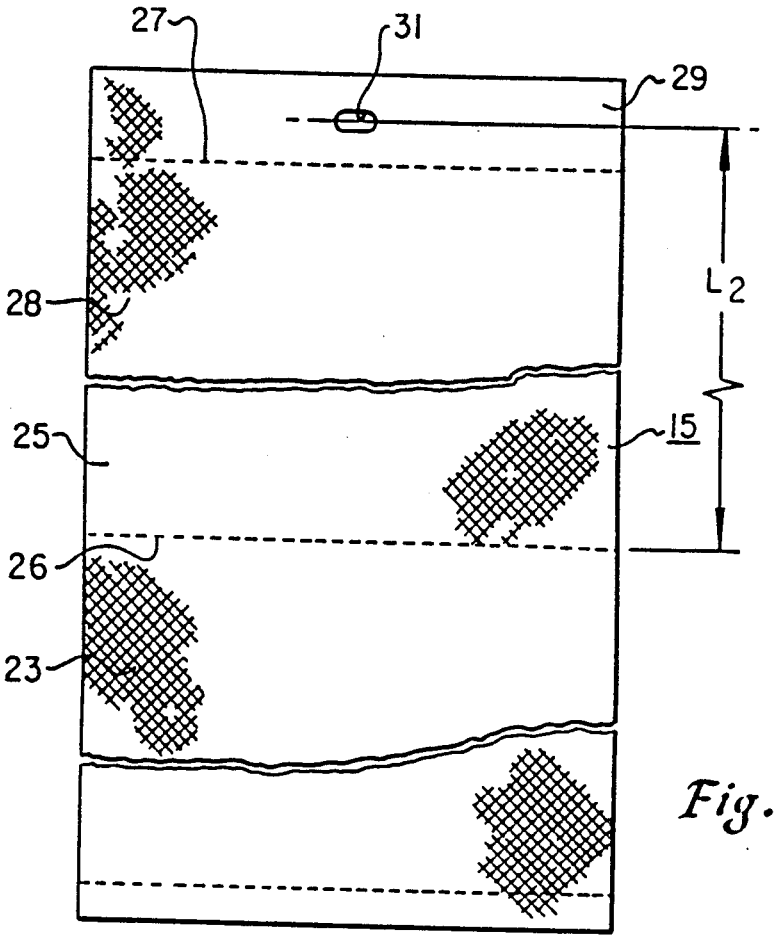
FIG. 5 is a plan view of a piece of material illustrating how the bag can be made from a single piece of material.
Figure 6:
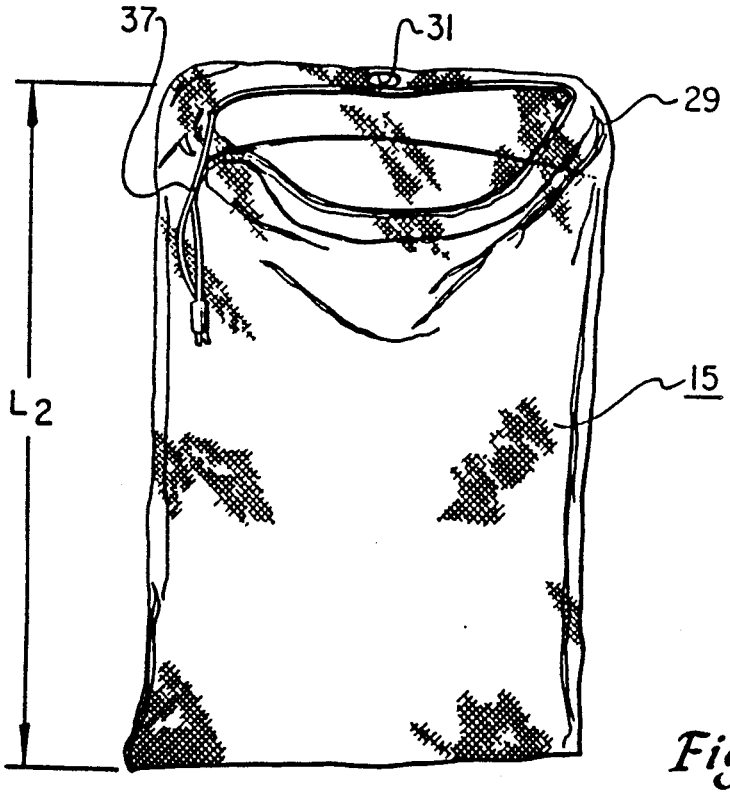
FIG. 6 is a view of a bag as finally sewed together.

Referring to the FIGS., in particular FIG. 1, there is illustrated the combination 11, including the bag holder 13 and the bag 15. The bag holder 13 is also illustrated completely in FIGS. 2–4. Referring to FIGS. 1–4, as can be seen therein, the bag is on a stud-type hanger without restriction at the top, the bag holder consists essentially of a base 17 for free standing; a vertical support means 19 for supporting the bag above the level of the floor, the vertical support means being connected rigidly with the base at an angle B (beta), FIG. 3; and a hanger rack means 21 for providing laterally extending support for removably supporting the bag. The bag 15 is illustrated more nearly completely in FIGS. 5 and 6. The bag 15 includes a flexible front portion 23 that is permeable to moisture; a flexible rear portion 25 that is permeable to moisture and has a bottom 26 and a top 27, with sides 28, FIG. 5. The flexible rear portion is connected to the front portion along its sides so as to be adapted to be openable at its top to receive dirty clothes or the like, but closed at the bottom, as by being bent along a line by an integral sheet of cloth, sewed, or the like. The bag also contains a yoke 29. The yoke 29 is connected with the rear portion adjacent its top, as by being bent along a bend line as illustrated in FIG. 5, being sewed along the top of the rear portion, or the like. The yoke is connected at at least its corners and may be sewed along its side but is open at its bottom to receive the hanger rack means. An aperture 31 is provided, as illustrated in FIGS. 1, 5 and 6, for receiving a central member of the vertical support means as will become clearer later hereinafter. This aperture 31 having extending therethrough the central member of the vertical support means provides lateral alignment and maintains the bag correctly positioned laterally of the hanger rack means 21.

Figure 4:
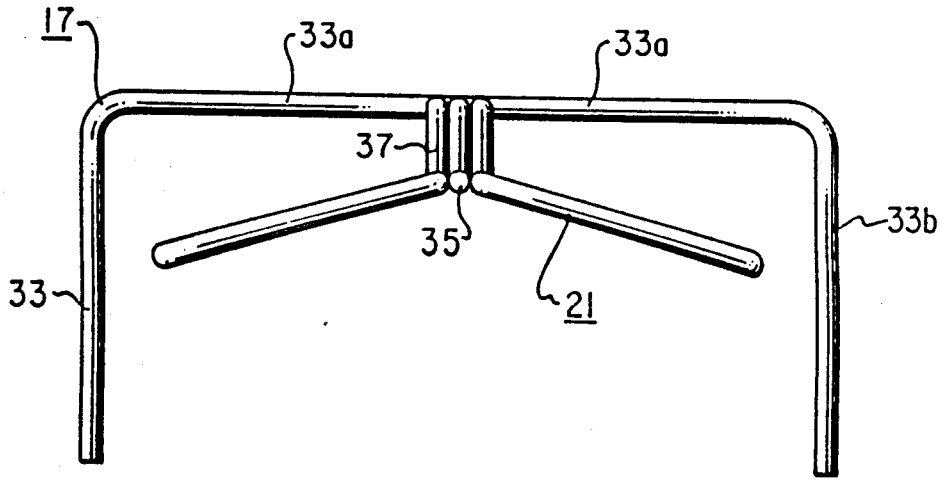
FIG. 4 is a top view of the embodiment of FIG. 2.
Figure 2:
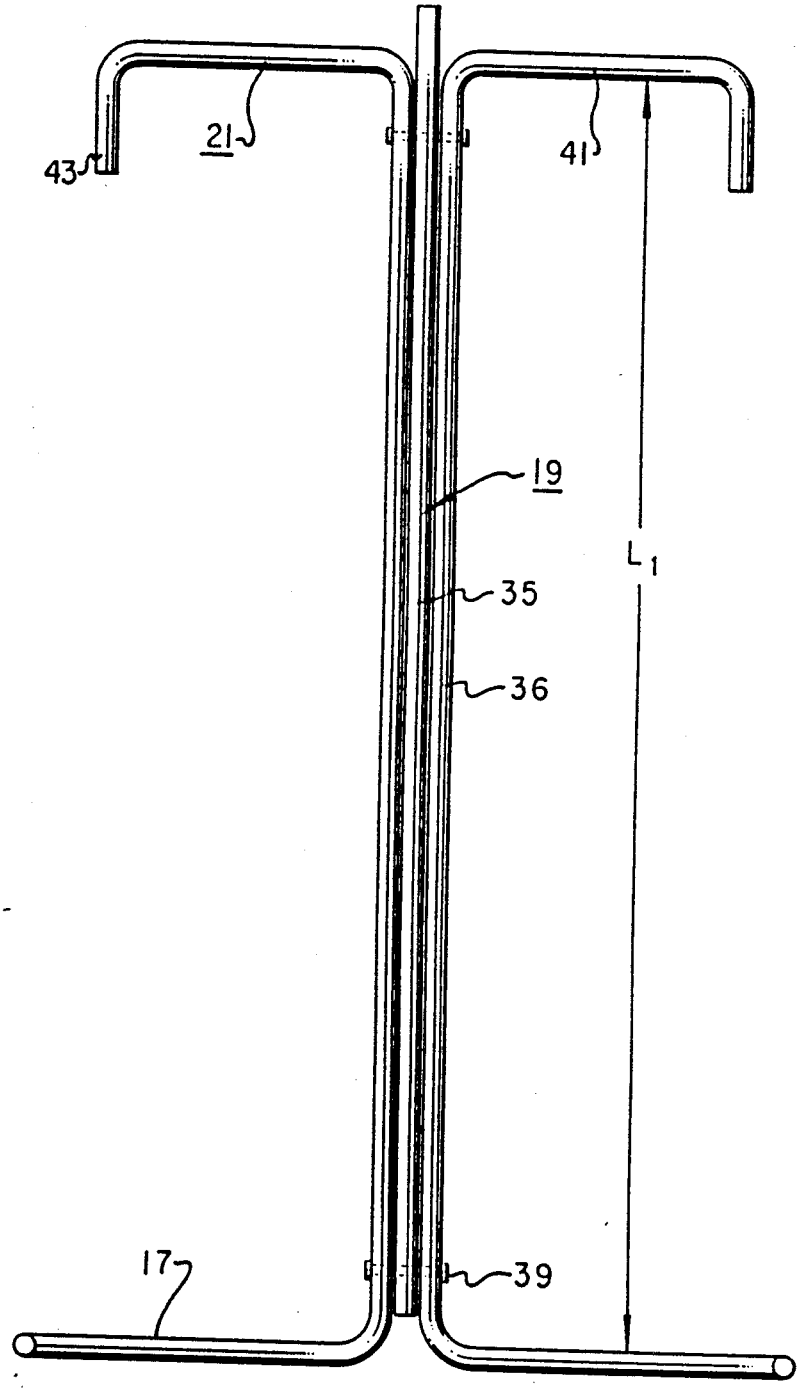
FIG. 2 is a front view of one embodiment of a bag holder in accordance with this invention.
Figure 3:
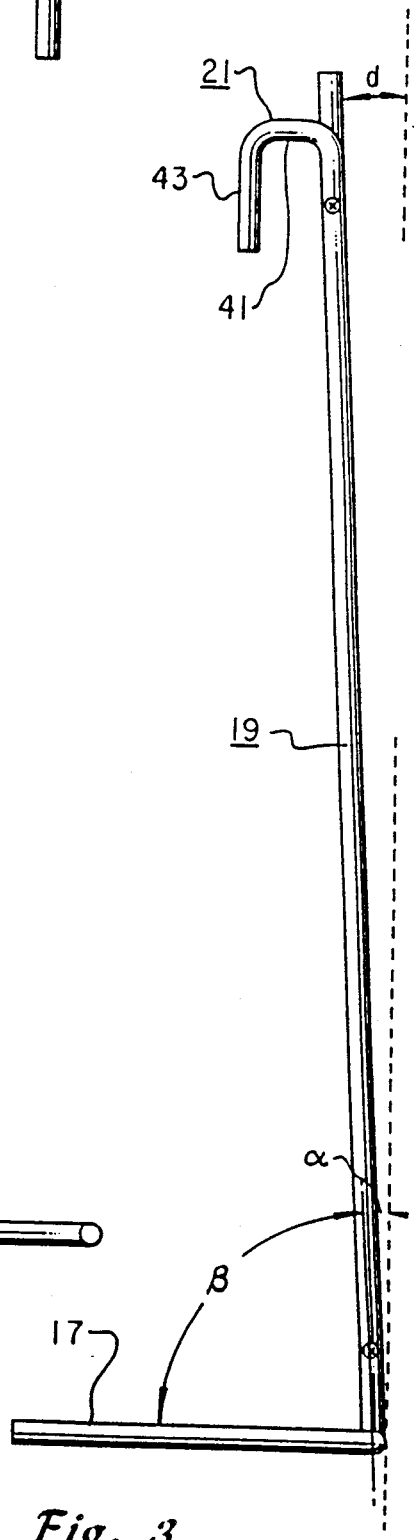
FIG. 3 is a side view of the embodiment of FIG. 2.

As illustrate in FIGS. 1–4 and particularly FIGS. 2–4, the bag holder 13 has as its base 17, a plurality of tubular members 33. As indicated, the rear tubular members **33*a* form the rear of the base and are in the same plane as the forwardly extending member 33*b*** and co-act to form a U-shaped tubular base structure for supporting the bag holder and the bag thereon in a free standing position.

The vertical support means 19 includes a central tubular support members 35 and a pair of laterally displaced vertical support members 37, one on either side, that are connected therewith for structural strength. In the illustrated embodiment of FIGS. 2 and 3, the three tubular members forming the vertical support means are bolted together, as by mating ends of screw bolts 39, at the top and bottom, penetrating through apertures through each of the respective tubes. In the illustrated embodiment, the respective tubes are bent so as to form the tubes of the base. It is readily apparent, however, that they can be welded or the like. Preferably, the tubes are formed of a structurally strong material such as metal that will not cold flow under continued stress application, as plastic is sometimes want to do. Specifically, aluminum tubes have been bent in the configurations illustrated and serve adequately. Other metals such as iron can be employed if desired. In addition, when metallic elements are employed, the respective tubes can be screwed into ells, tees and the like to give the desired structure.

The vertical support means 19 is connected with the base 17 at an angle beta, in the range of 80°-90°; for example, about 85°. This allows the top to incline inwardly slightly so as to hold the bag with a clearance from the combination 11. This is salutary in allowing installation of the bag and removal of the bag, as well as allowing circulation of air about the bag to dry the moisture from the clothes therewithin. Another way of expressing the angle is that it forms and angle a(alpha) in the range of 3°-10°, for example, about 5°; with respect to a vertical plane such as a wall that is contiguous, or flush with the back of the base 17, as by being against the tubular members 33*a*, FIG. 4. This approach allows a clearance of a distance d, FIG. 3, of about 3-½inches from the vertical plane that is flush with the back of the base.

The hanger rack means 21 comprises a pair of laterally extending tubular members 41 for supporting the bag. As indicated, the laterally extending members 41 extend forwardly slightly although they appear foreshortened in FIG. 3.

As illustrated, the laterally extending members 41 are integrally formed with the respective members 36 to the vertical support means on both sides of the central member 35.

In the illustrated embodiment, the laterally extending tubular members 41 also have a downwardly turned portion 43 that facilitates insertion of the bag and prevents pulling of thread or the like in the material from cut ends of the tubing.

It is noteworthy that the bag is shorter than the stand such that the bottom of the bag is held off the floor, as illustrated in FIG. 1. Specifically, the stand, or holder, will have a length $L_1$ which is of a first length whereas the bag will have the length $L_2$ which is shorter than $L_1$.

In the illustrated embodiment, the bag is formed of a nylon fishnet material. It may be formed of other materials such as cotton or the like but it is preferable, however, if it be formed of material that is resistant to mildew, such that any clothes that are tossed thereinto will have an opportunity to dry. As noted, it is imperative that both the front and back be permeable to moisture. In the illustrated embodiment, as can be seen if FIGS. 1 and 6, the bag 15 has a drawstring 37 that can be pulled to close the bag and hold any clothes therewithin. Expressed otherwise, the drawstring traverses peripherally around the top of the bag in a hem or hem-like construction such that pulling on the drawstring will cause the top of the bag to be closed sufficiently to hold therewithin any clothes that have been tossed thereinto. Thus, simply pulling on the drawstring will enable moving the bag and any clothes contained therewithin from its bag holder 13.

In operation, the bag 15 is fitted onto the holder 13 by the simple expedient of putting the yoke over the hanger rack means.

Once the bag 15 is in place in the bag holder 13, the top being ensured to hang open, clothes may be thrown thereinto as desired. The clothes or anything coming into the bag will dry because of the permeability to moisture and the circulation of air about the bag. When it is ready to remove the bag, the bag can be simply lifted up and the top pulled closed by pulling on the drawstring 37.

A new bag can be emplaced similarly as described hereinbefore and the clothes taken to the laundry or cleaner in the bag if desired. On the other hand, of course, the clothes can be emptied out of the bag by leaving the top open or through an opened top when at the cleaners, laundry or the like.

While the application has disclosed the use of the bag with the bag holder, it should be noted that the bag can be emplaced on a conventional type hanger and hung in the closet or the like.

Similarly, the bag holder can be employed to hold other bags instead of the bag 15 of this invention.

While the bag holder has been illustrated as being bolted together by bolts through the apertures, it is readily apparent that the respective members making up the vertical support means can be welded together or otherwise formed into a unitary vertical support means. Moreover, it is necessary that the tubes be as close to the center member 35 as illustrated, since they can be spread apart farther.

If desired, aluminum tubing may be employed and bent into shape. If desired, the aluminum can be anodized, or colored, during its manufacture or can be painted after being formed into the bag holder 13. In the illustrated embodiment, the aluminum tubes are painted white after being made into the bag holder.

One use invisioned for this application is for forming laundry bags or the like for including in dorms, since the school colors can be readily incorporated into the bag holder and the bag or either alone.

While nylon net has been disclosed hereinbefore, polyester nylon or polyester cotton be employed as the fabric material; if desired.

Although this invention has been described with a certain degree of particularity, it is understood that the present disclosure is made only by way of example and that numerous changes in the details of construction and the combination and arrangement of parts may be resorted to without departing from the spirit and the scope of the invention, reference being had for the latter purpose to the appended claims.

What is claimed is:

1. A bag for being hung on a studtype hanger above a first surface and receiving dirty clothes and the like comprising:

a. a flexible front portion that is permeable to moisture;

b. a flexible rear portion having a top, bottom and sides and connected to said front portion along said sides so as to be able to have a top of the bag opened to receive dirty clothes and the like, said rear portion being permeable to moisture;

c. a draw string for drawing the top closed and for pulling said bag from said stud-type hanger without restriction at the top, said draw string being disposed adjacent the top of the bag so as to be above said studtype hanger and operable to effect closing and removal of said bag in one operation; and d. A yoke containing corners and bottom and connected with said rear portion adjacent the top of said rear portion for hanging on said stud-type hanger without restriction on top, and yoke being at least connected at its corners and open at its bottom to receive a hanger means such that the bag is released when the drawstring is pulled, whereby said bag can be hung above a first portion such as the floor and said clothes can have any moisture that they contain evaporate and be retained ready to be sent to the cleaners and said bag and any clothes contained therein can be pulled from its hanger when the drawstring is pulled.

* * * * *